US008853572B2

(12) United States Patent
Ahlert et al.

(10) Patent No.: US 8,853,572 B2
(45) Date of Patent: Oct. 7, 2014

(54) ELECTRIC SWITCH

(75) Inventors: Torsten Ahlert, Fürstenwalde (DE); Marc Liebetruth, Glienicke (DE); Katja Manthey, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 247 days.

(21) Appl. No.: 13/353,374

(22) Filed: Jan. 19, 2012

(65) Prior Publication Data

US 2012/0186957 A1 Jul. 26, 2012

(30) Foreign Application Priority Data

Jan. 20, 2011 (DE) ..... 10 2011 002 930

(51) Int. Cl.
*H01H 9/02* (2006.01)

(52) U.S. Cl.
USPC ..... 200/293; 335/202

(58) Field of Classification Search
None
See application file for complete search history.

(56) References Cited

U.S. PATENT DOCUMENTS

| | | | | |
|---|---|---|---|---|
| 5,304,761 | A * | 4/1994 | Rosen et al. | 218/157 |
| 6,747,535 | B2 * | 6/2004 | Castonguay et al. | 335/132 |
| 6,806,800 | B1 | 10/2004 | Castonguay | |
| 2002/0050891 | A1 | 5/2002 | Castonguay et al. | |
| 2003/0071702 | A1 | 4/2003 | Castonguay | |

FOREIGN PATENT DOCUMENTS

| | | | |
|---|---|---|---|
| DE | 3839269 | A1 | 5/1990 |
| DE | 10254259 | A1 | 6/2004 |
| DE | 60035937 | T2 | 5/2008 |
| DE | 102010035571 | | 3/2012 |

OTHER PUBLICATIONS

Certified Priority document for German Application No. 10 2011 002 930.3 (Not Yet Published), Jan. 20, 2011.

* cited by examiner

*Primary Examiner* — Renee Luebke
*Assistant Examiner* — Ahmed Saeed
(74) *Attorney, Agent, or Firm* — Harness, Dickey & Pierce, P.L.C.

(57) ABSTRACT

An electric switch is disclosed including an at least two-part housing including a first housing part, a second housing part connected to the first housing part and including at least one pole cartridge which is enclosed by the two-part housing and is preassembled in the second housing part. In at least one embodiment, the first housing part is connected to the pole cartridge with the aid of at least one fastening device.

19 Claims, 7 Drawing Sheets

ELECTRIC SWITCH

PRIORITY STATEMENT

The present application hereby claims priority under 35 U.S.C. §119 to German patent application number DE 10 2011 002 930.3 filed Jan. 20, 2011 the entire contents of which are hereby incorporated herein by reference.

FIELD

At least one embodiment of the invention generally relates to an electric switch. The electric switch, in at least one embodiment, has an at least two-part housing including a first housing part, a second housing part connected to the first housing part and at least one pole cartridge which is enclosed by the two-part housing and is preassembled in the second housing part.

BACKGROUND

Electric switches that have a two-part housing including a first and a second housing part are available on the market. The first housing part forms an upper component of the housing and the second housing part a lower component. Typically the two housing parts are made of plastic and joined to each other.

The first housing part, i.e. the upper component, typically has a connecting section onto which an adapter for connecting a motor drive can be fixed. Screws, for example, can be screwed into the first housing part in order to secure the adapter, thereby fixing the adapter in place on the first housing part. The motor drive is then attached to the adapter. Alternatively the motor drive can also be attached directly to the upper component without the use of an adapter. If no motor drive is to be employed with the known prior art switch, a device front cover can alternatively be mounted on the upper component instead of the motor drive.

According to DE 10 2010 035 571, a motor drive can be attached to the first housing part by means of screws. For that purpose the motor drive is for example hooked into place in a first region facing toward the first housing part and secured by means of the screwed fastening in a second region of the part of the motor drive facing toward the first housing part. There are thus two fastening regions of the motor drive in total: a first for hooking into place and a second for the screwed fastening.

Particular attention must be accorded to the force flow in the switching device due to the shock effect when the electric switch is operated and due to vibrations. In addition the ambient temperature and the self-heating of the switch during operation constitute a further material stress.

SUMMARY

In at least one embodiment of the invention discloses an electric switch which has an improved load-bearing capacity for motor drives, in particular for heavy motor drives, compared with conventional switches.

At least one embodiment of the invention corresponds to an electric switch. Advantageous embodiments of the switch according to the invention are disclosed in dependent claims.

It is provided according to an embodiment of the invention that the electric switch has an at least two-part housing including a first housing part, a second housing part connected to the first housing part and at least one pole cartridge which is enclosed by the two-part housing and is preassembled in the second housing part, the first housing part being connected to the pole cartridge with the aid of at least one fastening device. The pole cartridge can be preassembled in the second housing part with the aid of the at least one fastening device, e.g. by way of screws.

An advantage of the switch according to an embodiment of the invention is that the first housing part (upper component) is stabilized in a form-fit and low-cost manner. The connection to the pole cartridge serves for stabilization.

In one embodiment variant the at least one fastening device is implemented as a snap-fit connection between the first housing part and the pole cartridge.

In an alternative embodiment variant the first housing part and the pole cartridge are connected to each other by means of an ultrasonic plastic welded joint.

In a further example embodiment the at least one fastening device is arranged at the edge of the connecting section for connecting a motor drive.

First housing part and second housing part can be formed from thermoplastic synthetic material. The pole cartridge can be embodied from thermosetting plastic material. This results in a more reliable and improved force-fit connection of the motor drive to the electric switch.

The first housing part and the pole cartridge can be formed from thermoplastic synthetic material and joined together by way of an ultrasonic plastic welded joint.

BRIEF DESCRIPTION OF THE DRAWINGS

The invention is explained in more detail below with reference to example embodiments illustrated in the drawing, in which by way of example.

DETAILED DESCRIPTION OF THE EXAMPLE EMBODIMENTS

Figure 1:
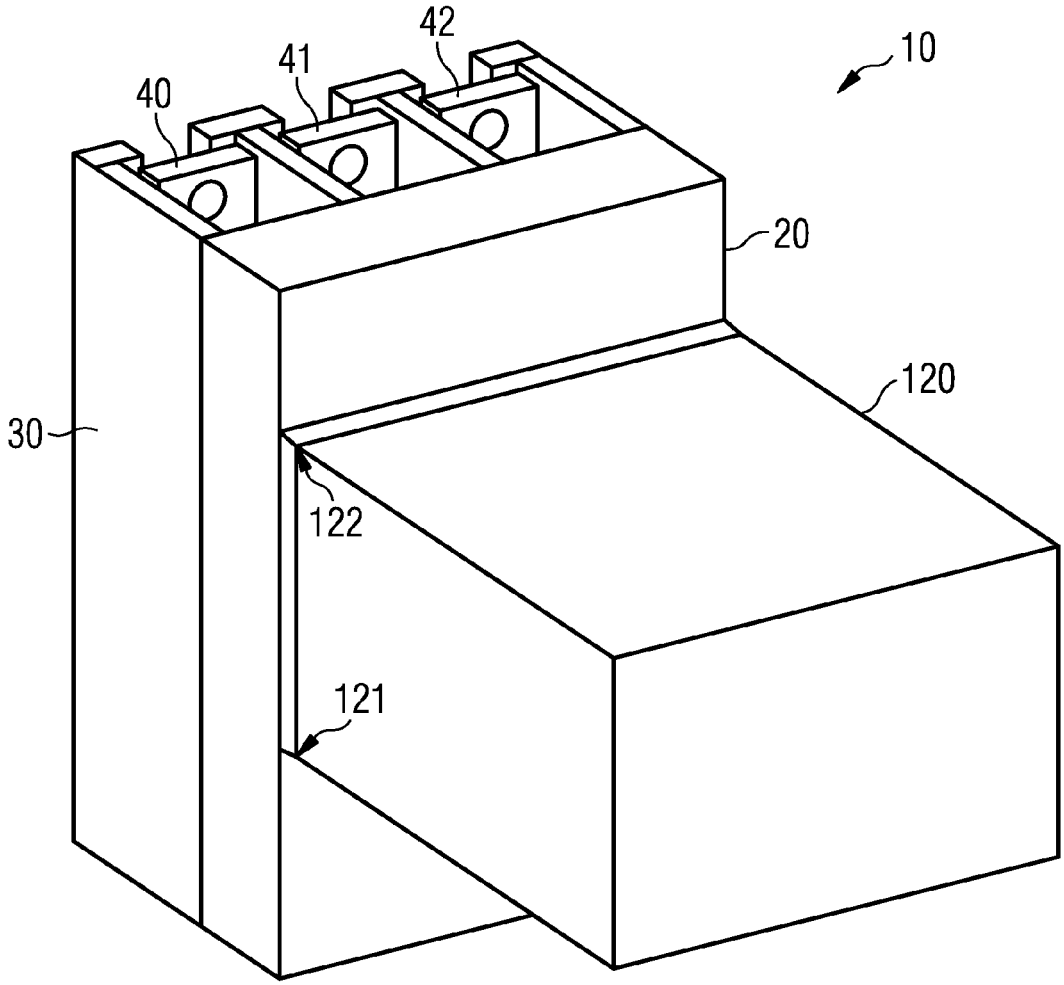
FIG. 1 shows a typical electric switch with a motor drive.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a typical electric switch 10, including a two-part housing including a first housing part 20 and a second housing part 30. The two-part housing encloses three pole cartridges 40, 41, 42, of which only the terminals located at the top are visible in FIG. 1. The pole cartridges 40, 41, 42 are preassembled in the second housing part 30. The first housing part 20 has a connecting section to allow connection of a motor drive 120. The first housing part 20 (upper component) is typically joined to the second housing part 30 (lower component) by way of screwed fastenings. On account of lack of space to accommodate screwed fastenings in the connecting section of the motor drive, fastening device(s) other than screws can be used in this section between first housing part 20 and second housing part 30.

A pole cartridge is an arrangement encapsulated in a casing for the purpose of switching an electric circuit. Typically a pole cartridge comprises a contact mechanism consisting of moving and fixed contacts as well as at least one arcing chamber for extinguishing an electric arc which forms during the switching operation.

The electric switch 10 can be a circuit breaker for switching an electric circuit or a power switch.

The motor drive 120 is used for example for automatically switching the electric switch on and off. Typically the motor drive 120 is connected to the first housing part 20 at a first region 121 and at a second region 122. In this arrangement a hooking-in fitting can be used for example for the connection in the first region 121, while screws can be used in the second region 122.

The mechanical connection between motor drive 120 and first housing part 20 can be subjected to severe stress due to vibrations resulting from the switching operation or due to the shock following switching actuation. Fluctuations in the ambient temperature in addition to the self-heating occurring during operation of the switch also lead to a further material stress. Severe mechanical stress can likewise occur in different installation positions of the combination consisting of electric switch 10 and motor drive 120.

The mechanical load imposed on the first housing part 20 can lead to the first housing part 20 becoming detached from the second housing part 30. It can also result in breakage of the first housing part 20.

Figure 2:
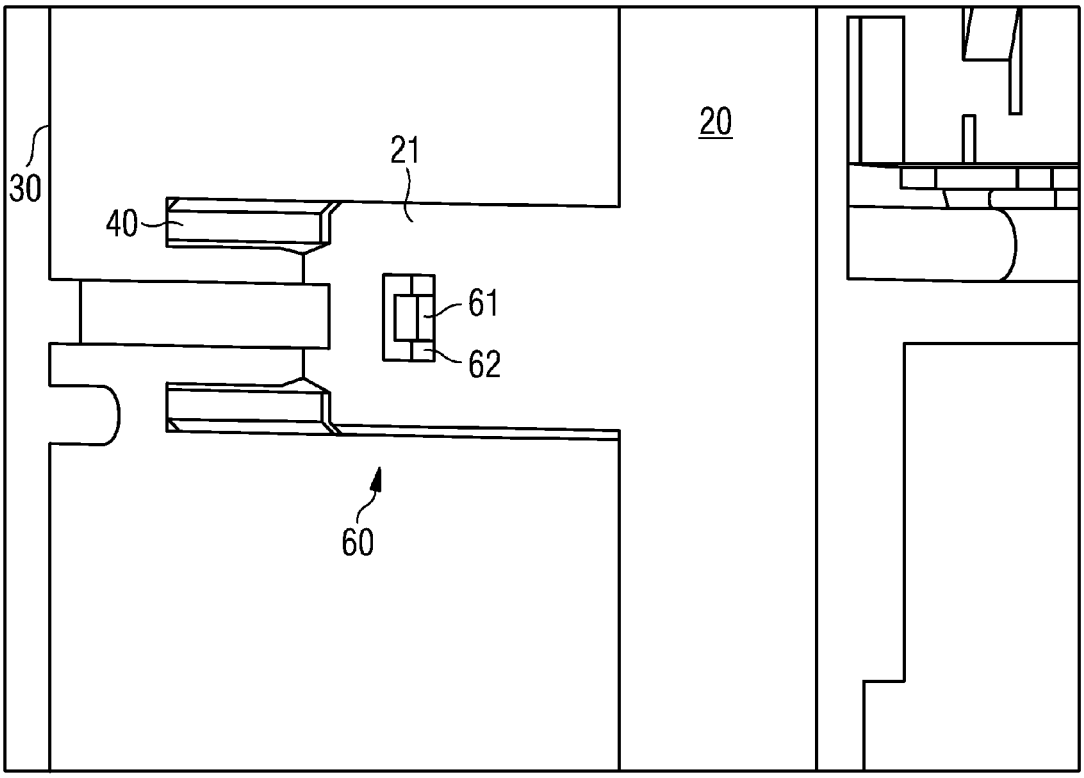
FIG. 2 shows a side view of an inventive fastening between first housing part and pole cartridge.

The inventive electric switch 10 is constructed as shown in FIG. 1 for example and in addition, as shown in FIG. 2, includes a connection of the first housing part 20 to the pole cartridge 40. In order to enable a connection between pole cartridge 40 and first housing part 20, the second housing part 30 has, on the long side facing toward the pole cartridge 40, at least one opening (not visible in FIG. 2) through which the latching projection 61 embodied on the pole cartridge 40 can be accessed. The first housing part 20 is connected to the pole cartridge 40 by way of a snap-fit fastening 60 of a snap-in opening 62 embodied on the first housing part 20 with the latching projection 61.

The first housing part 20 is stabilized as a result of the first housing part 20 being connected to the pole cartridge 40 by means of a snap-fit fastening. The snap-fit fastening 60 achieves a form-fit and low-cost stabilization of the first housing part 20. The snap-fit fastening 60 is advantageous especially in the case of sidewise installation positions and the first housing part 20 can be manufactured from thermoplastic materials in spite of high mechanical stresses due to the weight of the motor drive 120.

Figure 3:
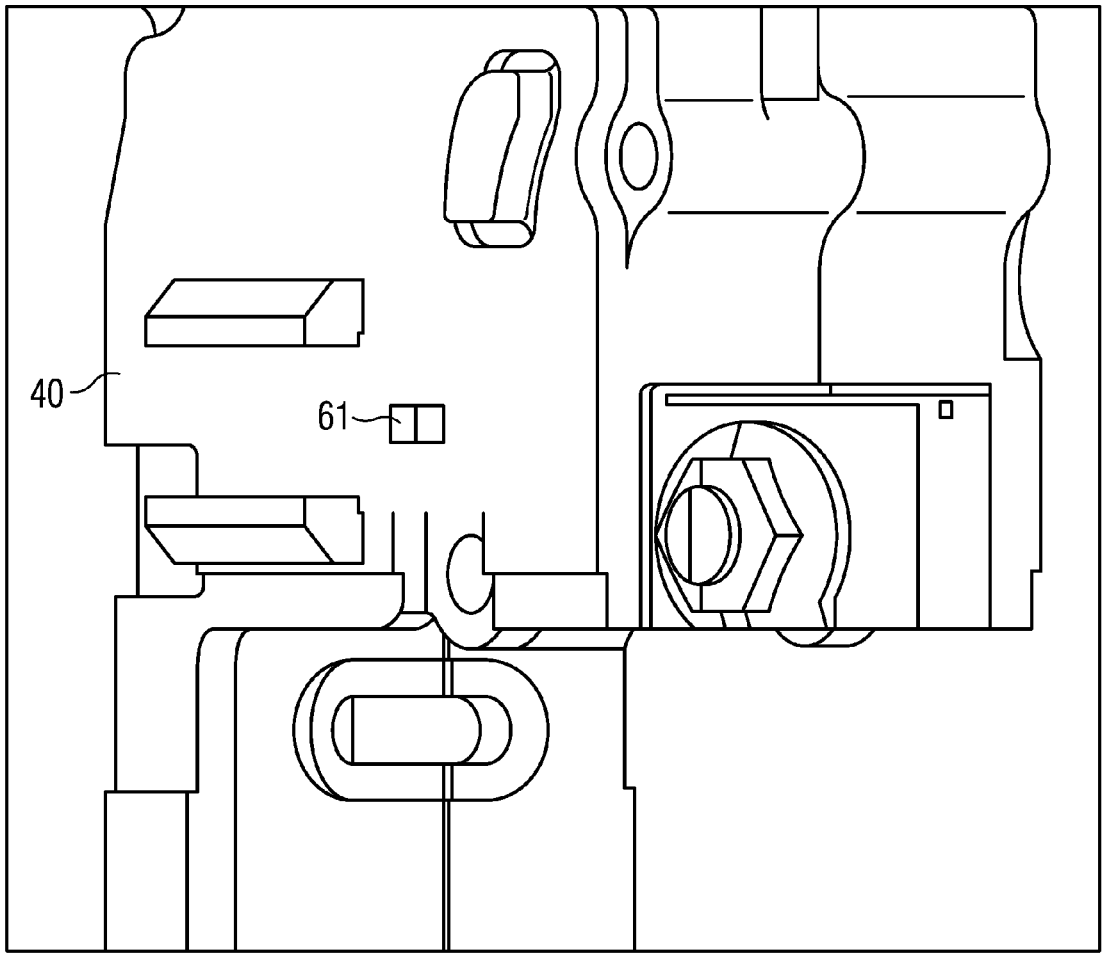
FIG. 3 shows a side view of a pole cartridge.

FIG. 3 shows a detailed view of the pole cartridge 40. The pole cartridge 40 is embodied such that the first housing part 20 can be connected to it by way of the latching projection 61.

Figure 4:
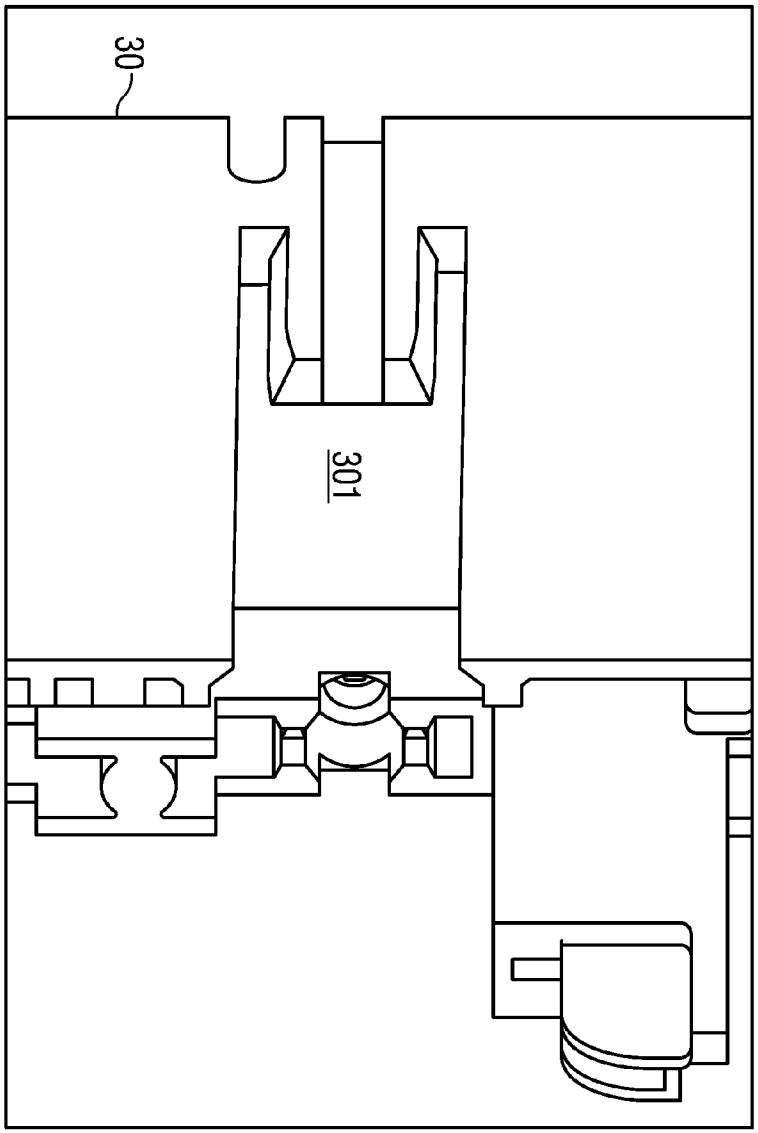
FIG. 4 shows a side view of a second housing part.

FIG. 4 shows a section of the second housing part 30 with the opening 301 through which the latching projection 61 of the pole cartridge 40 can be accessed in the preassembled state. In the assembled state the second housing part 30 of the two-part housing is joined to the first housing part 20 by means of the snap-fit fastening 60.

Figure 5:
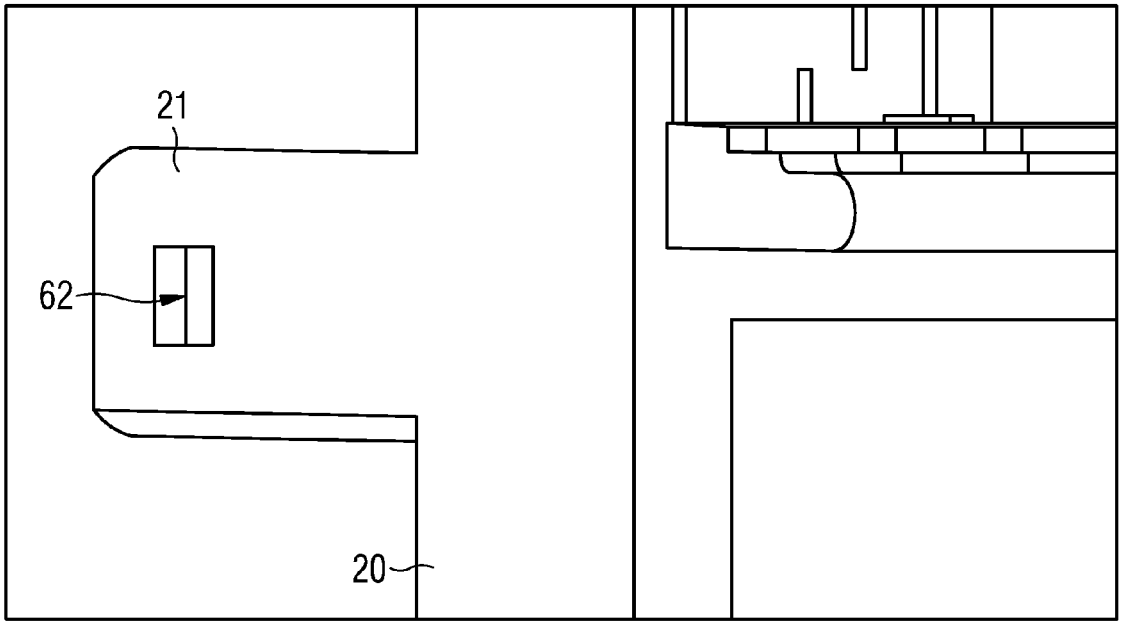
FIG. 5 shows a side view of a first housing part.

FIG. 5 shows the first housing part 20 with a lug 21 and the snap-in opening 62 which is located within the lug 21. The first housing part 20 can be connected in a snap-fit manner by way of the lug 21 to the latching projection 61 of the pole cartridge 40.

Figure 6:
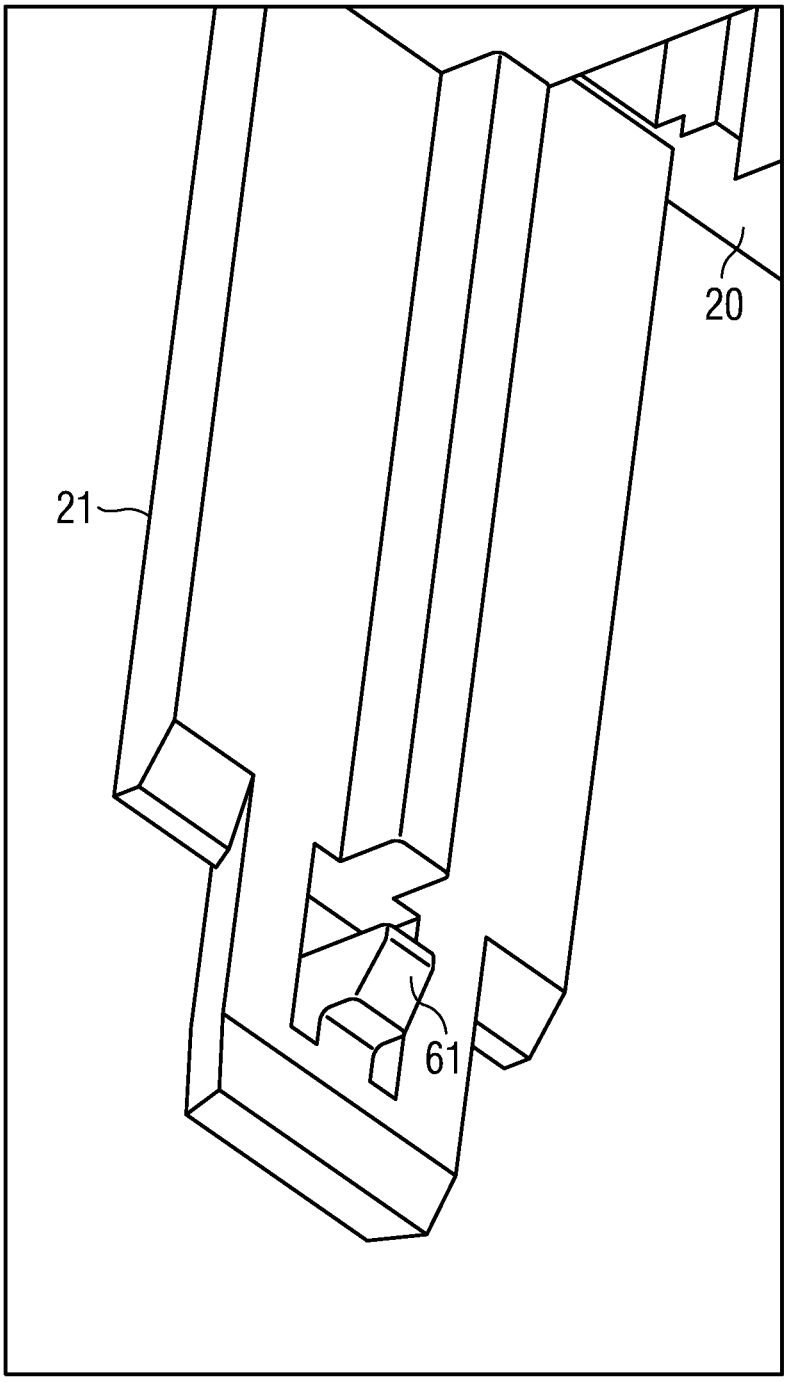
FIG. 6 shows a side view of a first housing part with alternative fastening device(s)
Figure 7:
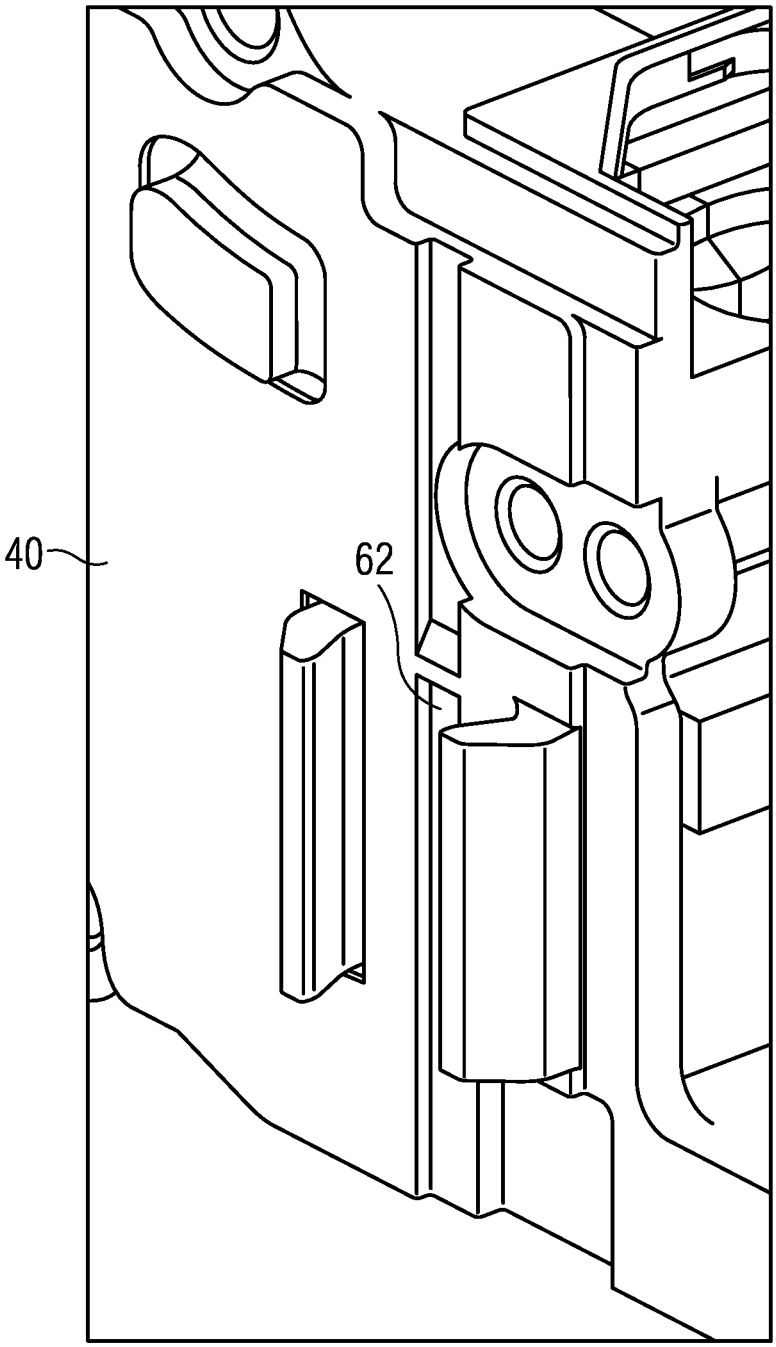
FIG. 7 shows a side view of a pole cartridge with alternative fastening device(s).

An alternative embodiment of the connection between the first housing part 20 and the pole cartridge 40 is illustrated in FIGS. 6 and 7. According to FIG. 6, the first housing part 20 has a lug 21 with a latching projection 61. Latching projection 61 is also referred to as a snap-action hook. As shown in FIG. 7, the pole cartridge 40 has a snap-in opening 62.

The latching projection 61 of the first housing part 20 cooperatively interacts with the snap-in opening 62 of the pole cartridge 40 and forms therewith the snap-fit fastening 60 between the first housing part 20 and the pole cartridge 40.

The snap-fit fastening can be located between first fastening region 121 and second fastening region 122 from motor drive 120 to first housing part 20. It is also possible for the snap-fit fastening joining the first housing part 20 to the pole cartridge 40, 41, 42 to be located at the level of the first fastening region 121 or the second fastening region 122.

Obviously a snap-fit fastening can also be achieved by way of at least two spaced-apart snap-in openings with two correspondingly spaced-apart latching projections which are embodied on corresponding lugs of the first housing part 20 and on the pole cartridge 40 analogously to the above-described implementations. A snap-fit fastening by way of one or more latching projections is advantageously realized also with the pole cartridge 42 adjoining the other lateral surface of the second housing part 30.

First housing part 20 and pole cartridge 40, 41, 42 can also be joined to each other by way of an ultrasonic plastic welded joint. After the pole cartridges 40, 41, 42 have been inserted into the second housing part 30 and the first housing part 20 has been mounted on top, the first housing part 20 and the outer pole cartridges 40 and 42 can be joined together by way of the ultrasonic plastic welding process. The effect of the ultrasound is to cause the mating surfaces of the first housing part 20 and the outer pole cartridges 40, 42 that are in contact with one another to be heated locally, resulting in the components being welded together. When the plastic welding process is employed, the first housing part 20 and the pole cartridge 40 are embodied from thermoplastic synthetic material.

In a further embodiment variant the first housing part 20 and the pole cartridge 40 are joined together by adhesive bonding. The first housing part 20 and the pole cartridge 40 can also be joined to each other by way of screws.

In one embodiment variant the first housing part 20 and the second housing part 30 are made of thermoplastic synthetic material. In one embodiment variant the pole cartridge 40, 41, 42 is made of thermosetting plastic material.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric switch, comprising:

an at least two-part housing including, a first housing part, a second housing part connectable to the first housing part, and at least one pole cartridge enclosable by the at least two-part housing and preassembled in the second housing part, the first housing part being connectable to the pole cartridge with the aid of at least one fastening device, the at least one fastening device including a latching projection and an opening configured to receive the latching projection to connect the first housing part and the at least one pole cartridge, the opening being formed in the first housing part and the latching projection being formed on the at least one pole cartridge.

2. The electric switch as claimed in claim 1, wherein the at least one fastening device includes a snap-fit fastening between the first housing part and the at least one pole cartridge.

3. The electric switch as claimed in claim 1, wherein the first housing part includes a connecting section to allow connection of a motor drive, and wherein the at least one fastening device is arranged at the edge of the connecting section to connect the motor drive.

4. The electric switch as claimed in claim 1, wherein the at least one pole cartridge is formed from thermosetting plastic material.

5. The electric switch as claimed in claim 1, wherein the first housing part and the second housing part are formed from thermoplastic synthetic material.

6. The electric switch as claimed in claim 1, wherein the first housing part and the at least one pole cartridge are formed from thermoplastic synthetic material and are joined together by way of an ultrasonic plastic welded joint.

7. The electric switch as claimed in claim 2, wherein the first housing part includes a connecting section to allow connection of a motor drive, and wherein the at least one fastening device is arranged at the edge of the connecting section to connect the motor drive.

8. The electric switch as claimed in claim 2, wherein the at least one pole cartridge is formed from thermosetting plastic material.

9. The electric switch as claimed in claim 2, wherein the first housing part and the second housing part are formed from thermoplastic synthetic material.

10. The electric switch as claimed in claim 2, wherein the first housing part and the at least one pole cartridge are formed from thermoplastic synthetic material and are joined together by way of an ultrasonic plastic welded joint.

11. The electric switch as claimed in claim 1, wherein the at least one fastening device is a snap-fit fastening between the first housing part and the at least one pole cartridge.

12. The electric switch as claimed in claim 1, wherein the opening is formed in a lug of the first housing part.

13. An electric switch, comprising:

an at least two-part housing including, a first housing part, a second housing part connectable to the first housing part, and at least one pole cartridge enclosable by the at least two-part housing and preassembled in the second housing part, the first housing part being connectable to the pole cartridge with the aid of at least one fastening device, the at least one fastening device including a latching projection and an opening configured to receive the latching projection to connect the first housing part and the at least one pole cartridge, the opening being formed in the at least one pole cartridge and the latching projection being formed on the first housing part.

14. The electric switch as claimed in claim 13, wherein the at least one fastening device includes a snap-fit fastening between the first housing part and the at least one pole cartridge.

15. The electric switch as claimed in claim 13, wherein the first housing part includes a connecting section to allow connection of a motor drive, and wherein the at least one fastening device is arranged at the edge of the connecting section to connect the motor drive.

16. The electric switch as claimed in claim 13, wherein the at least one pole cartridge is formed from thermosetting plastic material.

17. The electric switch as claimed in claim 13, wherein the first housing part and the second housing part are formed from thermoplastic synthetic material.

18. The electric switch as claimed in claim 13, wherein the first housing part and the at least one pole cartridge are formed from thermoplastic synthetic material and are joined together by way of an ultrasonic plastic welded joint.

19. The electric switch as claimed in claim 13, wherein the latching projection is formed on a lug of the first housing part.

* * * * *